United States Patent [19]

Goff, Jr. et al.

[11] 4,397,085

[45] Aug. 9, 1983

[54] METHOD OF MANUFACTURE OF A MULTI-WIRE NONIMPACT PRINTHEAD

[75] Inventors: Willie Goff, Jr.; William M. Jenkins, Both of Austin, Tex.

[73] Assignee: International Business Machines Corporation, Armonk, N.Y.

[21] Appl. No.: 213,516

[22] Filed: Dec. 5, 1980

[51] Int. Cl.[3] ..... H01K 3/10

[52] U.S. Cl. ..... 29/850; 29/826; 29/603; 156/174; 346/155

[58] Field of Search ..... 29/592, 163.5 CW, 603, 29/850, 825, 826; 346/155, 76 R, 76 PH; 219/216; 156/172, 174

[56] References Cited

U.S. PATENT DOCUMENTS

| | | | |
|---|---|---|---|
| 3,586,562 | 6/1971 | Jones | 156/174 |
| 3,693,185 | 9/1972 | Lloyd | 346/155 X |
| 3,862,394 | 1/1975 | Lane | 219/216 |
| 3,978,494 | 8/1976 | Noker | 219/216 X |
| 4,011,692 | 3/1977 | Bos et al. | 51/323 |
| 4,131,986 | 1/1979 | Escriva et al. | 29/592 R |
| 4,330,349 | 5/1982 | Swift et al. | 29/826 X |

FOREIGN PATENT DOCUMENTS

| | | | |
|---|---|---|---|
| 647531 | 2/1979 | U.S.S.R. | 346/76 PH |

*Primary Examiner*—Francis S. Husar
*Assistant Examiner*—Carl J. Arbes
*Attorney, Agent, or Firm*—J. Jancin, Jr.; Andrea P. Bryant; Joseph F. Villella

[57] ABSTRACT

A method of making a plurality of multi-wire nonimpact printheads provides precise inter-wire spacing accuracy and repeatability of manufacturing steps to enable mass production.

A plurality of slats are molded, one alongside another on a cylindrical support shell, parallel to the shell axis. A helical thread is engraved on the slats along the axial length of the support shell. A continuous wire is wrapped in the thread and the portions of the wire on the slats are encapsulated. The support shell and wrapped wire is cut between adjacent slats to obtain a plurality of printhead blanks. Each blank is machined to smooth the exposed print wires. The resultant printheads may be used in page- width nonimpact printers.

16 Claims, 8 Drawing Figures

METHOD OF MANUFACTURE OF A MULTI-WIRE NONIMPACT PRINTHEAD

TECHNICAL FIELD

This invention relates generally to a multi-wire nonimpact printhead and more particulary to a method of making multi-wire nonimpact printheads.

Nonimpact printing using a multi-wire printhead is well known in the printing art. Examples of nonimpact printing techniques are electroerosion, resistive ribbon and thermal printing. In nonimpact printing, the print wires do not actually strike the print medium to obtain an image. As a result, inertia and other mechanical forces created by high speed print element impact need not be overcome. Nonimpact printers are thus capable of high speed printing, while remaining mechanically simple.

The first nonimpact printers included a printhead having a sufficient number of wires to print a vertical slice of a selected character. The printhead scanned across a page in a line by line fashion to print a full page. Recently, nonimpact printers including a multi-wire printhead having a sufficient number of wires (e.g., several hundred wires) to print an entire page in one scan have been developed. By using such a page-width printhead, printing speed may be dramatically increased and printer construction simplified, as the head may be maintained stationary and the paper passed thereover to print a full page.

The advent of page-width printers has imposed stringent requirements on the printhead manufacturing process, because several hundred wires must be incorporated into the page-width printhead with precise dimensional accuracy. Several wires must be precisely aligned in a row with a precisely defined spacing between adjacent wires. Moreover, in order to produce an inexpensive page-width printer, the printhead manufacturing process must be amenable to automated mass production techniques, with a minimal number of manufacturing steps and minimal human intervention. Each manufacturing step must produce a repeatable result to ensure printhead uniformity.

BACKGROUND ART

A method of manufacturing a page-width wire printhead is disclosed in U.S. Pat. No. 4,131,986 to Escriva et al. Closely spaced wire windings are laid down on a revolving drum and retained in place by an adhesive substrate previously mounted on the drum. The cylinder comprising the adhesive substrate and wire windings is cut, removed from the drum and spead into a flat sheet. The wire side of the sheet is then placed in contact with the epoxy surface of an elongated plate. After the epoxy has dried, the adhesive substrate is removed and the newly exposed side of the wire is placed in contact with the epoxy surface of a second elongated plate. The resultant sandwichlike structure is then trimmed and polished to form a wire printhead.

The precise interwire spacing required of a page-width printhead cannot be assured using the Escriva et al. method. Since the wire is laid shown on a revolving drum and retained in place by an adhesive, any winding irregularities or winding tension variations will result in improperly spaced windings. Further, the removal of the cylinder from the drum and subsequent cylinder flattening may result in further winding deformation and consequent inaccurate print wire spacing. The cylinder removal and flattening steps are likewise not amenable to mass production techniques, especially if the winding spacing is not to be disturbed.

DISCLOSURE OF THE INVENTION

It is a principle object of this invention to provide an improved method of manufacturing a multi-wire printhead.

It is another object of the invention to provide a method of manufacturing a multi-wire printhead with the requisite wire spacing accuracy and repeatability of manufacturing to enable low cost manufacture.

It is a further object of the invention to provide a method of mass producing a plurality of mutli-wire printheads at one time in a minimum number of steps.

These and other objects are accomplished by a method of making a multi-wire printhead wherein a plurality of slats are molded one alongside another on a cylindrical support shell parallel to the shell axis. A helical thread is engraved on the slats along the axial length of the cylindrical support shell. A continuous wire is then wrapped in the thread and the portions of the wire on the slats are encapsulated. The cylindrical support shell and the wrapped wire is then cut between adjacent slats parallel to the shell axis to obtain a plurality of printhead blanks. Each blank is machined and lapped at both ends to smooth the exposed print wires. Each printhead may be used in a page-width nonimpact printer.

By first engraving a thread on the slats and then wrapping a wire in the thread, correct spacing of adjacent wire windings is assured. Adjacent winding spacing is determined solely by the thread spacing, and not by winding tension variations. Further, dismantling of the cylindrical structure does not take place until after the wire has been encapsulated, thus precluding additional winding deformation. Printhead uniformity is thereby assured. A plurality of printheads are produced at one time, using steps that are simple in nature and amenable to mass production techniques.

BEST MODE FOR CARRYING OUT THE INVENTION

Figure 1:
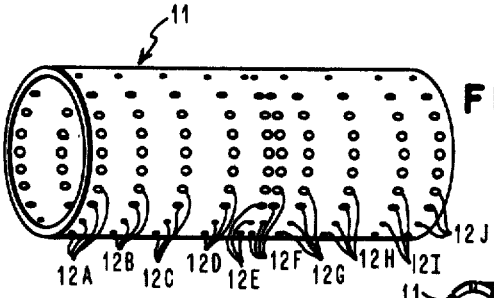
FIGS. 1 through 7 are step-by-step illustrations of the sequential manufacturing techniques employing the present invention.

Referring to FIGS. 1–7 in detail, there is shown the results of sequential manufacturing operations embodying the present invention for producing a multi-wire printhead. In FIG. 1, a cylindrical support shell 11, preferably of metal, is obtained, for example by forming and welding a flat metal sheet. As shown in FIG. 1, support shell 11 includes a plurality of rows of punched holes 12*a*–12*j*. The purpose of these holes will become apparent below.

Figure 2:
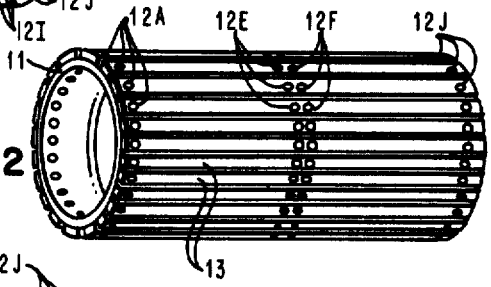
Figure 3:
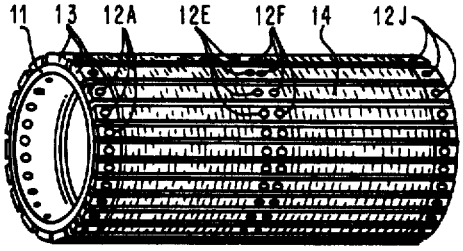

In FIG. 2, shell 11 has been used as a mold insert and a series of inboard slats 13 molded on the surface thereof. Inboard slats 13 are molded to lie one alongside another and parallel to the axis of shell 11. Holes 12*a*, 12*e*, 12*f*, and 12*j*, are used for aligning and holding shell 11 in place in the mold via a series of mold pins which pass through the holes. Inboard slats 13 are held in place on shell 11 by allowing the molding material to flow into and fill holes 12*b*, 12*c*, 12*d*, 12*g*, 12*h* and 12*i*. Slats 13 are molded of a suitable plastic or other material. Suitable molding machines for molding inboard slats 13 onto shell 11 are well known to those skilled in the art and will not be further described here. It will be noted that by providing alignment holes 12*a*, 12*e*, 12*f* and 12*j*, the molding step may be accomplished without human adjustment or intervention, to obtain precise and repeatable results.

The structure of FIG. 2 including shell 11 and molded inboard slats 13 is then placed on a lathe or other suitable groove cutting machine and a helical thread 14 is engraved on inboard slats 13 along the axial length of shell 11. The pitch, depth and other thread characteristics are determined by the desired printhead wire size, shape and spacing.

Precision lathes are well known to those skilled in the art and may be employed to engrave a precisely spaced thread on slats 13.

Figure 4:
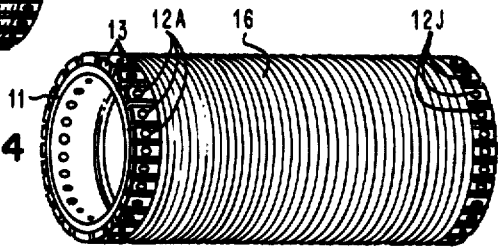

As shown in FIG. 4, a wire 16 is wrapped in thread 14. The diameter of wire 16 will depend on the particular printhead to be made. Wire 16 may be of tungsten or other suitable material. It will be noted that the winding machine for wrapping wire 16 in thread 14 may be of simple construction, as the accuracy of wire wrapping is determined by the accuracy of thread 14 and not by the winding machine accuracy. Wire 16 is retained in a precisely defined spacing pattern by thread 14. This pattern is unaffected by wire winding machine tension or spacing variations, thus permitting greater tolerances in winding tension and spacing than the prior art.

The structure of FIG. 4 is used as a mold insert, and outboard slats 17 molded thereon. Holes 12*a* and 12*j* are employed for aligning and supporting the structure within the mold as was done in the first molding step of FIG. 2. In the embodiment shown in FIG. 5, two subslats, 17*a* and 17*b* are molded on each inboard slat 13, as each inboard slat 13 is used to make two printheads. Depending upon the size of the printhead and the molding machine, a single outboard slat 17 or a plurality of subslats may be molded on each inboard slat 13. The molding of outboard slats 17 in alignment with inboard slats 13 encapsulates wrapped wire 16 on each inboard slat 13. Wire 16 remains unencapsulated between adjacent inboard slats 13.

Figure 5:
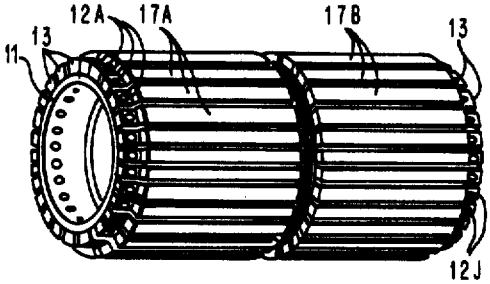
Figure 6:
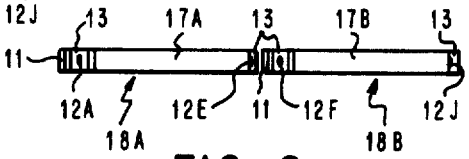

The structure of FIG. 5 is cut or diced, parallel to the axis of shell 11 between each inboard slat 13 through wire 16 and shell 11. Alignment holes 12*a* and 12*j* may be employed to facilitate alignment for cutting between adjacent inboard slats 13. It will be noted that since wire 16 was previously encapsulated, the cutting will not affect the spacing of adjacent wire windings on inboard slats 13. The result of the parallel cuts is a plurality of bars each of which contains two printhead blanks 18*a*, 18*b*. Each bar is then cut in half to separate the two printhead blanks 18*a*, 18*b*, as shown in FIG. 6. Cutting may be accomplished via electronic discharge machining, laser cutting or other conventional cutting techniques.

Figure 7:
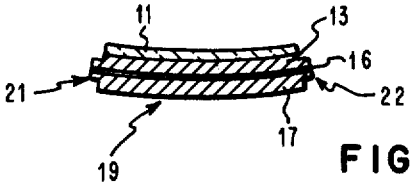

Each printhead blank of FIG. 6 is further processed to obtain a multi-wire printhead 19 shown in cross section in FIG. 7. Shell 11, inboard slat 13 and outboard slat 17 are cut away at each end 21, 22 of printhead 19 in order to better expose wire 16. The exposed ends of the wire and the adjacent portions of slats 13 and 17 are ground and lapped to make the printhead end smooth and polished and ensure intimate contact with the print medium. Either end is used for the print function and the other end accepts a flat conductor cable (not shown in FIG. 7) for electrical connection of the printhead to printer control circuitry (not shown in FIG. 7).

Many variations in the above described printhead manufacturing method may be envisioned by those skilled in the art, to adapt the method to the size and type of manufacturing equipment available and satisfy different printer applications. For example, the length and diameter of cylindrical shell 11 may be varied to accommodate varying numbers of slats in single or multi-row configurations. The resulting printheads may be employed in line-width or page-width printing. Similarly, groove depth, pitch and spacing may be varied to accommodate different wire sizes. The wire size may be varied to accommodate printer resolution and power handling requirements. The composition of shell 11, slats 13 and 17, and wire 16 may be varied depending upon the type of nonimpact printing desired.

Variations in the individual steps of FIGS. 1-7 may likewise be envisioned by those skilled in the art. For example, inboard slats 13 may be connected together to form a cylindrical structure of inboard slats, thus rendering support shell 11 unnecessary. Further, either or both of discrete inboard slats 13 or outboard slats 17 may be replaced by an equivalent continuous inboard cylindrical shell or outboard cylindrical shell, respectively. If inboard slats 13 are replaced by an inboard cylindrical shell, a helical thread is engraved on the inboard cylindrical shell and a wire wrapped thereon, analogous to the operation of FIGS. 3 and 4. If outboard slats 17 are replaced by an outboard cylindrical shell, the outboard shell is molded on the structure of FIG. 4. If both an inboard and outboard shell is employed, cutting takes place at regular intervals, parallel to the shell axis to form the printhead blanks of FIG. 6. Similarly, means other than outboard slats 17 or an outboard cylindrical shell may be envisioned by those skilled in the art for encapsulating wire 16. Further, the engraving step of FIG. 3 may be eliminated if uniform wire winding (tension and spacing) can be assured. Since dismantling of the cylindrical structure does not take place until after the wire has been encapsulated, wire spacing irregularities will be precluded, and an improvement over the prior art will be attained.

Figure 8:
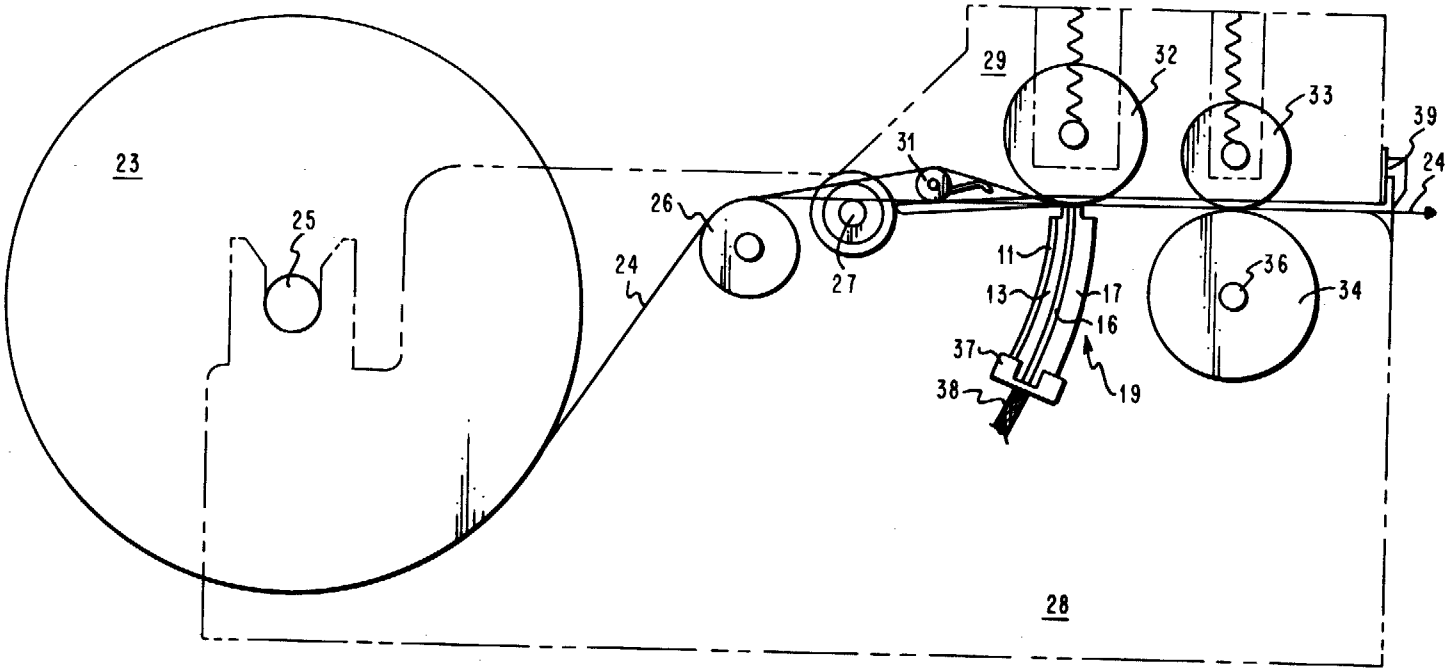
FIG. 8 is a diagrammatic cross section of a page-width nonimpact printer employing a multi-wire printhead manufactured by the process of the present invention.

FIG. 8 illustrates a high speed nonimpact page-width printer employing a multi-wire printhead made by the method of the present invention. As will be seen, this printer is characterized by a minimal number of moving parts and consequent low cost.

A roll 23 of electroerosion paper 24 is mounted in frame 28 for rotation about supply shaft 25. Initial paper threading is accomplished by pivoting top cover 29 about pivot 27 and extending paper 24 over roller 26, ground strap 31, printhead 19, drive roller 34 and underneath paper cutter 39. Cover 29 is then closed, to bring ground strap 31 in contact with paper 24 and to align spring loaded pressure rollers 32 and 33 with printhead 19 and drive roller 34, respectively. Cover 29 may be opened at any time for maintenance purposes or for loading a new roll of paper.

To print, paper 24 proceeds over roller 26 and ground strap 31. Ground strap 31 establishes proper grounding contact with paper 24 so as to enable wire printing to take place. The paper then passes over printhead 19. Printhead 19 is a page-width multi-wire printhead made by the process of this invention, and contains a sufficient number of wires 16 to print with the required resolution. Printhead 19 is rigidly mounted in frame 28 through mounting holes 12a and 12e (not shown in FIG. 8). Printhead 19 incorporates a portion of metal shell 11 as its base member for added rigidity.

Since printhead 19 is page-width, it need not be moved to scan a page in a line by line fashion. Paper 24 is driven across printhead 19 at a constant speed by drive roller 34 (the axis 36 of which is connected to a motor, not shown in FIG. 8) and printing across the entire width of paper 24 occurs. Electrical connector 37 is connected to the nonprint end of printhead 19, for electrically connecting cable 38 with print wires 16. In contrast with other printhead designs, printhead 19 may be easily disconnected by merely disconnecting electrical connector 37. Cable 38 is connected to printer control circuitry (not shown) for energizing print wires 16 in a proper pattern in accordance with the information to be printed. After a page has been printed, the page may be torn off against paper cutter 39.

It will be noted that carriage means for moving the head across the page in a line by line fashion are not necessary. Likewise, complex paper start/stop drive control is not required as driver roller 34 need only be driven at a constant speed to print an entire page. This mechanical simplicity greatly reduces printer cost, while page-width printing results in high speed.

Whereas we have illustrated and described the preferred embodiment of the invention, it is to be understood that we do not limit ourselves to the precise construction herein disclosed and the right is reserved to all changes and modifications coming within the scope of the invention as defined by the appended claims.

What is claimed is:

1. A method of making a plurality of multi-wire printheads comprising the steps of:

forming a cylindrical support shell, assembling a plurality of inboard slats on said cylindrical support shell, parallel to the longitudinal axis thereof, engraving a helical thread across said inboard slats, wrapping a wire in said helical thread, assembling a plurality of outboard slats on the wrapped wire, a respective one of said outboard slats being aligned with a respective one of said inboard slats, and cutting the cylindrical support shell and the wrapped wire parallel to the longitudinal axis of the cylindrical support shell between adjacent inboard slats to produce a plurality of multi-wire printheads having said cylindrical support shell as an integral part thereof.

2. A method of making a plurality of multi-wire printheads comprising the steps of:

assembling a plurality of inboard slats, one alongside another, into a cylindrical structure, with the inboard slats lying parallel to the longitudinal axis of the cylindrical structure;

engraving a helical thread across said inboard slats;

wrapping a wire in said helical thread;

assemblying a plurality of outboard slats on the wrapped wire, a respective one of said outboard slats being aligned with a respective one of said inboard slats; and cutting the wrapped wire parallel to the longitudinal axis of the cylindrical structure, between adjacent outboard slats to produce a plurality of multi-wire printheads having said plurality of inboard slats as an integral part thereof.

3. A method of making a plurality of multi-wire printheads comprising the steps of:

forming an inboard cylindrical shell, engraving a helical thread on said inboard cylindrical shell, wrapping a wire in said helical thread, forming an outboard cylindrical shell on the wrapped wire, and cutting through the inboard cylindrical shell, the wrapped wire and the outboard cylindrical shell, at a plurality of locations parallel to the longitudinal axis of the inboard cylindrical shell to produce a plurality of multi-wire printheads having said inboard cylindrical shell as an integral part thereof.

4. A method of making a plurality of multi-wire printheads comprising the steps of:

assembling a plurality of slats, one alongside another, to form a cylindrical structure, with the slats lying parallel to the longitudinal axis of the cylindrical structure, engraving a helical thread across said slats, wrapping a wire in said helical thread, forming a cylindrical shell on the wrapped wire, and cutting through the cylindrical shell and the wrapped wire parallel to the longitudinal axis of the cylindrical shell between adjacent slats, to produce a plurality of multi-wire printheads having said plurality of slats as an integral part thereof.

5. A method of making a plurality of multi-wire printheads comprising the steps of:

forming a cylindrical shell, engraving a helical thread on said cylindrical shell, wrapping a wire in said helical thread, assembling a plurality of slats on the wrapped wire, one alongside another, with the slats lying parallel to the longitudinal axis of the cylindrical shell, and cutting the wrapped wire and the cylindrical shell parallel to the axis of the cylindrical shell, between adjacent slats, to produce a plurality of multi-wire printheads, each of said plurality of multi-wire printheads having a section of said cylindrical shell as an integral part thereof.

6. A method of making a plurality of multi-wire printheads comprising the steps of:

assembling a plurality of slats, one alongside another, into a cylindrical structure, with the slats lying parallel to the longitudinal axis of the cylindrical structure, engraving a helical thread across said slats, wrapping a wire in said helical thread, encapsulating the wrapped wire on said slats, and cutting the wrapped wire parallel to the longitudinal axis of the cylindrical structure, between adjacent slats to produce a plurality of multi-wire printheads having said plurality of inboard slats as an integral part thereof.

7. A method of making a plurality of multi-wire printheads comprising the steps of:

assembling a plurality of inboard slats, one alongside another, into a cylindrical structure, with the inboard slats lying parallel to the longitudinal axis of the cylindrical structure;

wrapping a wire on said inboard slats, in a helical pattern along the length of the cylindrical structure, assembling a plurality of outboard slats on the wrapped wire, a respective one of said outboard slats being aligned with a respective one of said inboard slats; and cutting the wrapped wire parallel to the longitudinal axis of the cylindrical structure, between adjacent outboard slats to produce a plurality of multi-wire printheads having said plurality of inboard slats as an integral part thereof.

8. The method of claim 1, 2, 3, 4, 5, 6 or 7 wherein the cutting step is followed by the step of machining the ends of each multi-wire printhead to smooth the wire ends.

9. The method of claim 4 wherein the assembling step comprises the step of attaching the plurality of slats, one alongside another to a cylindrical support shell.

10. The method of claim 1 wherein the first assembling step comprises the step of molding the plurality of inboard slats on the surface of said cylindrical support shell.

11. The method of claim 1 wherein the forming step comprises the substeps of punching a row of holes in a flat sheet, and bending the flat sheet into a cylinder with the row of holes running perpendicular to the longitudinal axis thereof, and wherein the first assembling step comprises the step of molding the plurality of inboard slats on the surface of said cylindrical support shell, each of said inboard slats covering and filling at least one of said holes to facilitate adhesion of the inboard slats to the support shell.

12. The method of claim 1 or 2 wherein the second assembling step comprises the step of molding the plurality of outboard slats on the wrapped wire, in alignment with said inboard slats.

13. The method of claim 1 or 2 wherein each outboard slat comprises a plurality of subslats placed end to end, and said cutting step is followed by the step of cutting each inboard slat between adjacent subslats.

14. The method of claim 2 wherein the inboard slats are formed of molded plastic.

15. The method of claim 4 where the slats are formed of molded plastic.

16. The method of claim 1 or 2 wherein the wire is tungsten.

* * * * *